US006375290B1

(12) United States Patent
Lin et al.

(10) Patent No.: US 6,375,290 B1
(45) Date of Patent: Apr. 23, 2002

(54) LOCK SNAP STRUCTURE OF SLIDE RAIL

(75) Inventors: Tsung-Lung Lin; Shih-Long Hwang; Chun-Chiang Wang, all of Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/964,473

(22) Filed: Sep. 28, 2001

(51) Int. Cl.[7] ..... A47B 88/00
(52) U.S. Cl. ..... 312/334.46; 312/334.44
(58) Field of Search ..... 312/334.44, 334.46, 312/334.47, 334.7, 333, 334.1; 384/18, 21, 22

(56) References Cited

U.S. PATENT DOCUMENTS 6,126,255 A * 10/2000 Yang ..... 312/334.46

FOREIGN PATENT DOCUMENTS

DE 4325920 A1 * 2/1995 ..... 312/334.44
SE 93146 A * 10/1938 ..... 312/334.44

* cited by examiner

*Primary Examiner*—Peter M. Cuomo
*Assistant Examiner*—Jerry A. Anderson
(74) *Attorney, Agent, or Firm*—Bacon & Thomas, PLLC

(57) ABSTRACT

A lock snap structure of a slide rail includes an inner rail provided with two adjacent locking plates and a locking groove between the two locking plates. Each locking plate is formed with a slope. An outer rail mounted on the inner rail is provided with a retaining plate which has a guide block which may move along the slope of the locking plates to enter the locking groove. A drawing plate mounted between the inner rail and the outer rail has a first end that may be pulled and a second end pulled by an elastic member. The drawing plate has a slot hole provided with a guide plate which has an oblique shoulder that may press the guide block when the drawing plate is moved, so that the guide block may detach from the locking groove between the locking plates.

9 Claims, 6 Drawing Sheets

LOCK SNAP STRUCTURE OF SLIDE RAIL

BACKGROUND OF THE INVENTION

1. Field of the Invention

The present invention relates to a lock snap structure of a slide rail, and more particularly to a slide rail used to guide a drawer or the support rack of a keyboard of a computer table. When the slide rail is assembled, it has a snap effect for preventing automatic detachment. In addition, the slide rail may be dismantled conveniently.

2. Description of the Related Art

A conventional slide rail in accordance with the prior art shown in FIG. 8 may be used to guide a drawer or the support rack of a keyboard of a computer table, and primarily comprises an inner rail 91, an outer rail 92, and an intermediate rail 93. The inner rail 91 is provided with a pivotable locking member 94 whose terminal end may be rested on a stop block 95 mounted on the outer rail 92 or the intermediate rail 93, thereby preventing detachment of a drawer that is combined on the inner rail 91. When the user wishes to remove the drawer, the locking member 94 may be biased to detach from the stop block 95, so that the drawer combined on the inner rail 91 may be removed.

The closest prior arts of which the applicant is aware are disclosed in the followings. A protruding flexible strip may be pressed, such that the drawer slide member may be locked or detached. When the flexible strip is pressed, the entire drawer may be pulled to be removed. In addition, another closest prior art of which the applicant is aware discloses a first lock assembly 40 including an outward extending release tab 49 that may be pressed so as to lock or detach the drawer.

However, all of the above-mentioned prior arts have a complicated construction. In addition, the entire drawer is easily detached to fall down due to touching unintentionally. Especially, in one of the above-mentioned prior art, the release tab 49 is easily broken due to an external hit.

SUMMARY OF THE INVENTION

The primary objective of the present invention is to provide a lock snap structure of a slide rail which has a simple construction, so that the slide rail may be manufactured and assembled conveniently.

A secondary objective of the present invention is to provide a lock snap structure of a slide rail, wherein the drawer may be detached easily, and the lock snap structure may have an exact snap lock function without incurring the problem of unintentional touching.

Another objective of the present invention is to provide a lock snap structure of a slide rail, wherein the slide rail may be positioned when it is pulled to the maximum length, so that the slide rail will not retract due to slight touch of an external force.

In accordance with the present invention, there is provided a lock snap structure of a slide rail comprising: an inner rail, having a face provided with at least one first locking plate and at least one second locking plate, a locking groove defined between the first locking plate and the second locking plate, adjacent ends of the first locking plate and the second locking plate having a greater height, each of the first locking plate and the second locking plate formed with a slope which is inclined and lowered from the adjacent end toward the other end; an outer rail mounted on the inner rail, the outer rail provided with a retaining plate, the retaining plate formed with at least one protruding guide block, the guide block capable of climbing and rising along the slope of the first locking plate and the second locking plate of the inner rail to enter the locking groove between the first locking plate and the second locking plate; and a drawing plate, mounted between the inner rail and the outer rail, and moved in a longitudinal direction, one end of the drawing plate capable of being pulled, the other end of the drawing plate being pulled by one end of an elastic member, the other end of the elastic member being hooked on the inner rail, such that the drawing plate can be returned to its original position, the drawing plate formed with a slot hole to allow protrusion of the first locking plate and the second locking plate of the inner rail, the slot hole of the drawing plate formed with at least one guide plate, the guide plate having two sides each formed with an oblique shoulder, the oblique shoulder of the guide plate capable of pressing the guide block of the retaining plate when the drawing plate is moved, so that the guide block may detach from the locking groove between the first locking plate and the second locking plate of the inner rail.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
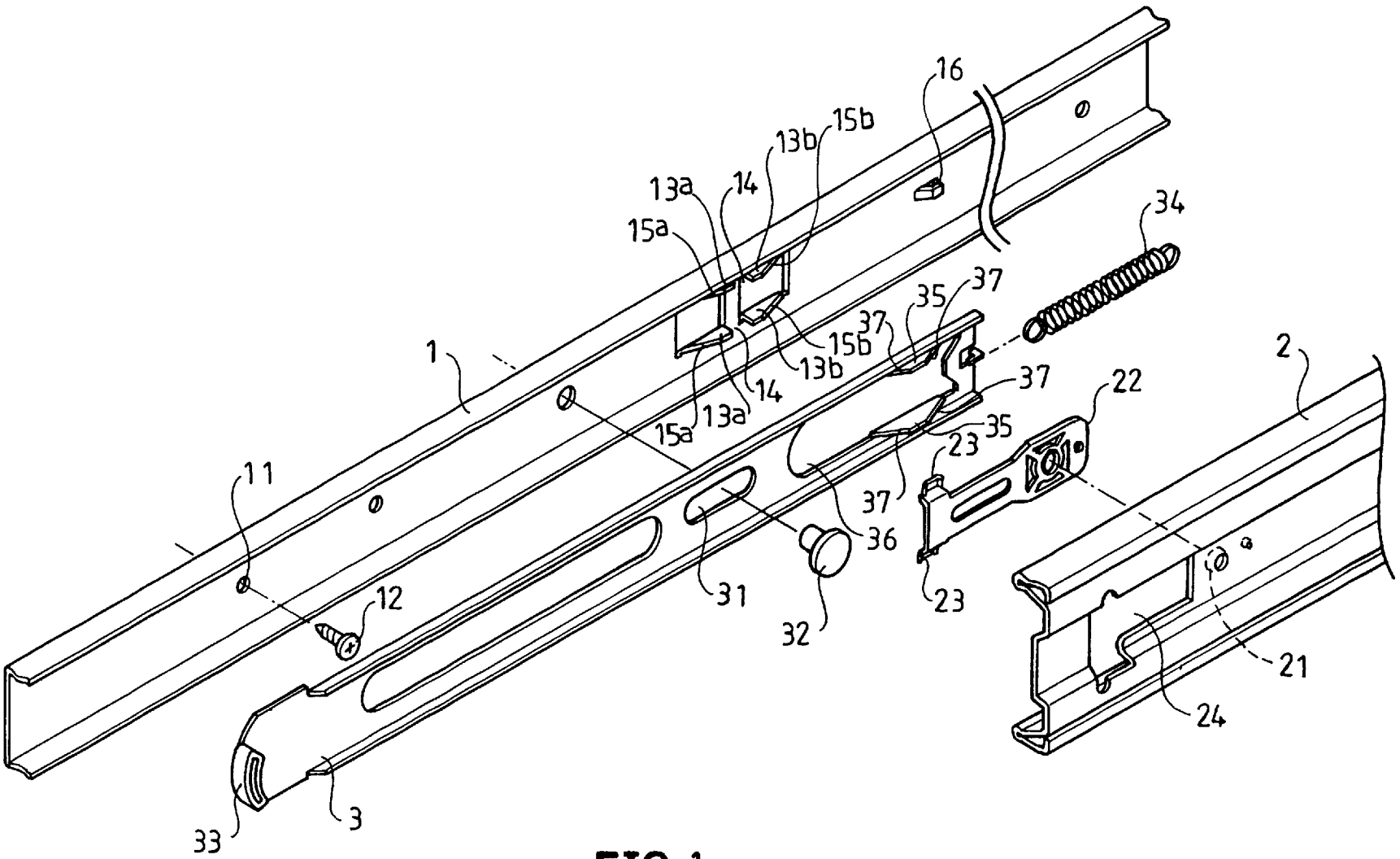
FIG. 1 is an exploded perspective view of a lock snap structure of a slide rail in accordance with the present invention.

Referring to the drawings and initially to FIG. 1, a lock snap structure of a slide rail in accordance with the preferred embodiment of the present invention comprises an inner rail 1, an outer rail 2, and a drawing plate 3.

The inner rail 1 defines positioning holes 11, so that the inner rail 1 my be fixed on the two sides of a drawer by positioning members 12. The inner rail 1 is formed with two opposite first locking plates 13*a,* and two opposite second locking plates 13*b* directed toward the outer rail 2. The first locking plate 13*a* and the second locking plate 13*b* are adjacent and symmetric with each other. The adjacent ends of the first locking plate 13*a* and the second locking plate 13*b* have a greater protruding height, and a locking groove 14 is defined between the first locking plate 13*a* and the second locking plate 13*b* each of the first locking plate 13*a* and the second locking plate 13*b* is formed with a slope 15*a* and 15*b* which is inclined and lowered from the position having a greater protruding height toward the other end.

The outer rail 2 is fixed on the wall of the furniture. A retaining plate 22 has a first end riveted and fixed on the outer rail 2 by a fixing member 21 such as a pin, and a second end formed with two opposite protruding guide blocks 23. The outer rail 2 is formed with a slot hole 24 to allow retraction of the retaining plate 22. The guide block 23 may be rested on the locking plates 13*a* and 13*b* and the slopes 15*a* and 15*b* of the inner rail 1, and may enter the locking groove 14 between the locking plates 13*a* and 13*b,* thereby achieving a positioning effect.

The drawing plate 3 is mounted between the inner rail 1 and the outer rail 2, and may move in a longitudinal direction relative to the inner rail 1. In the preferred embodiment, the drawing plate 3 defines an elongated slot 31 for passage of a guide rod 32 which may be fixed in the inner rail 1, thereby limiting the distance of the longitudinal movement of the drawing plate 3. One end of the drawing plate 3 may be pulled, and is provided with a lug 33 for facilitating grip of the user. The other end of the drawing plate 3 is pulled by one end of an elastic member 34, so that the drawing plate 3 may be returned to its original position automatically after being released. The other end of the elastic member 34 is fixed on a hook 16 of the inner rail 1. The drawing plate 3 is formed with a slot hole 36 to allow protrusion of the locking plates 13*a* and 13*b* of the inner rail 1. The two sides of the slot hole 36 of the drawing plate 3 are formed with two opposite protruding guide plates 35. Each guide plate 35 has two sides each formed with an oblique shoulder 37. The oblique shoulder 37 of the guide plate 35 may be rested on the guide block 23 of the retaining plate 22. The maximum height of the guide plate 35 is respectively greater than that of the first locking plate 13*a* and the second locking plate 13*b*. Thus, the guide plate 5 may push the guide block 23 to detach from the locking groove 14.

Figure 2:
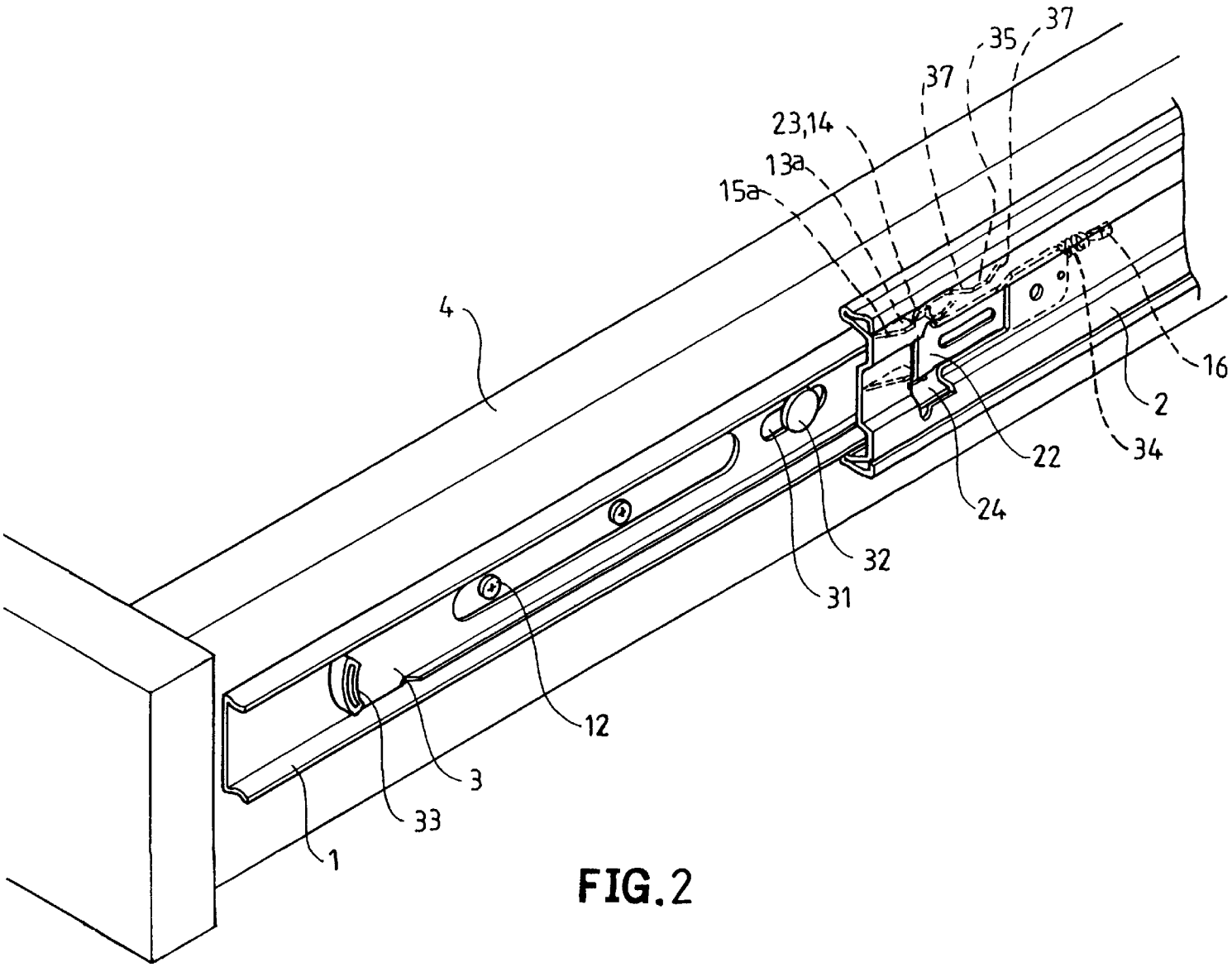
FIG. 2 is a perspective assembly view of the lock snap structure of a slide rail shown in FIG. 1.
Figure 3:
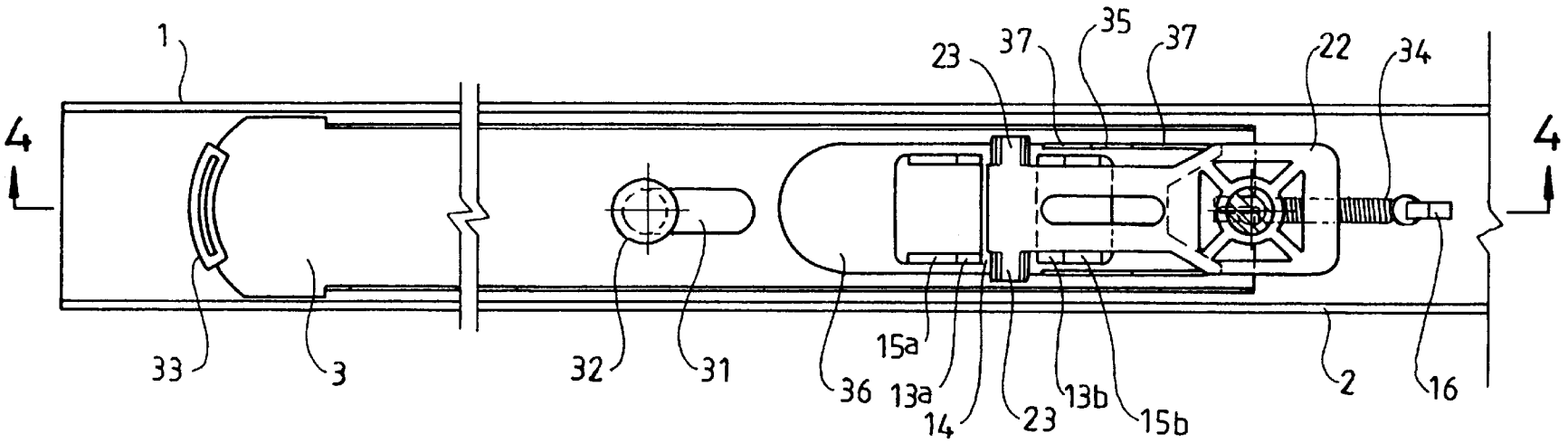
FIG. 3 is a front plan view of the lock snap structure of a slide rail as shown in FIG. 2.

Referring to FIGS. 2 and 3, the parts of the lock snap structure in accordance with the preferred embodiment of the present invention have been assembled. The inner rail 1 my be fixed on the two sides of the drawer 4, and the outer rail 2 may be fixed on the wall of the furniture. The drawing plate 3 is mounted between the inner rail 1 and the outer rail 2.

Figure 4:
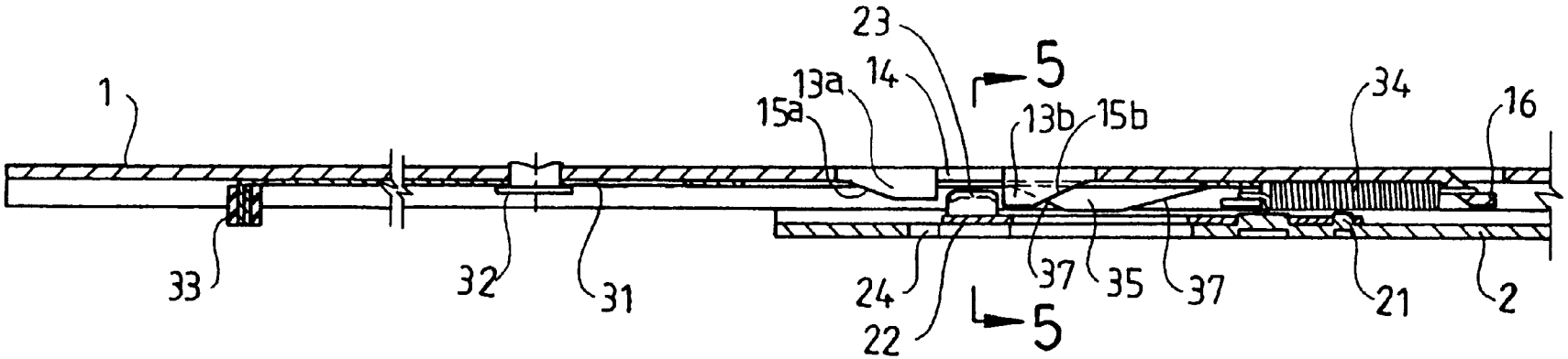
FIG. 4 is a cross-sectional view of the lock snap structure of a slide rail along line 4—4 a own in FIG. 3.
Figure 5:
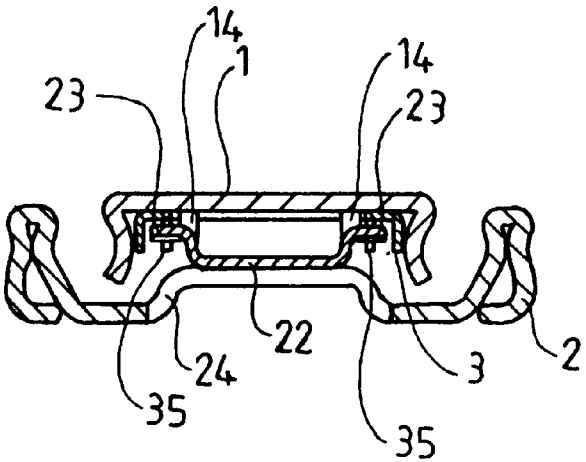
FIG. 5 is a cross-sectional view of the lock snap structure of a slide rail along line 5—5 shown in FIG. 4.

Referring to FIGS. 4 and 5, when the inner rail 1 combined on the drawer 4 is pulled outward, the inner rail 1 is moved relative to the drawing plate 3 to a limited maximum distance. The guide block 23 of the retaining plate 22 may climb and rise along the first slope 15*a* of the first locking plate 13*a,* and may be locked in the locking groove 14 of the inner rail 1 after passing through the first locking plate 13*a*. Thus, the drawer 4 combined with the inner rail 1 may be pulled outward until the guide block 23 is locked in the locking groove 14 between the first locking plate 13*a* and the second locking plate 13*b,* thereby forming a positioning effect. At this time, the guide plate 35 of the drawing plate 3 is not pressed on the guide block 23.

Figure 6:
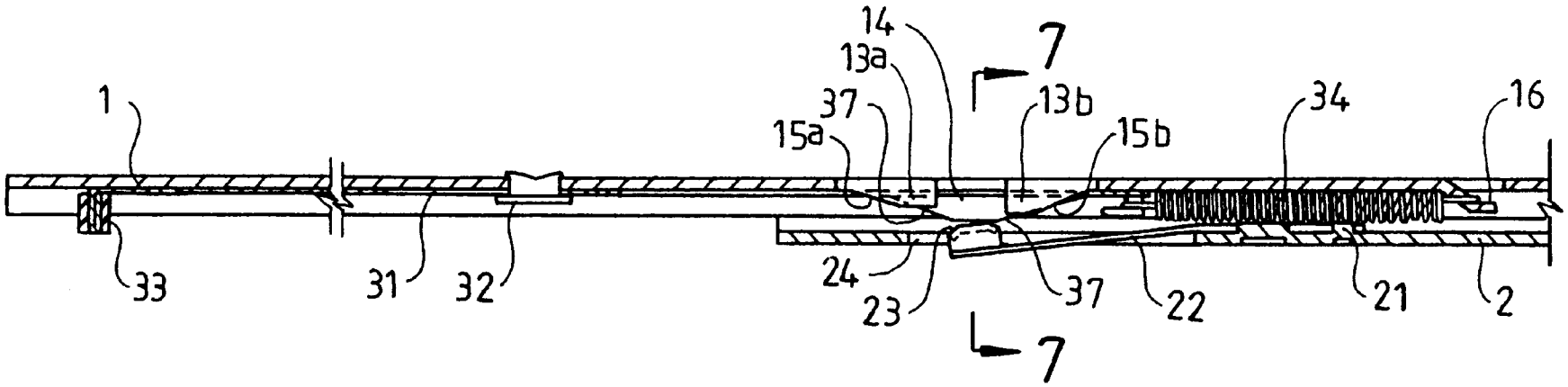
FIG. 6 is an operational view of the lock snap structure of a slide rail as shown in FIG. 4.
Figure 7:
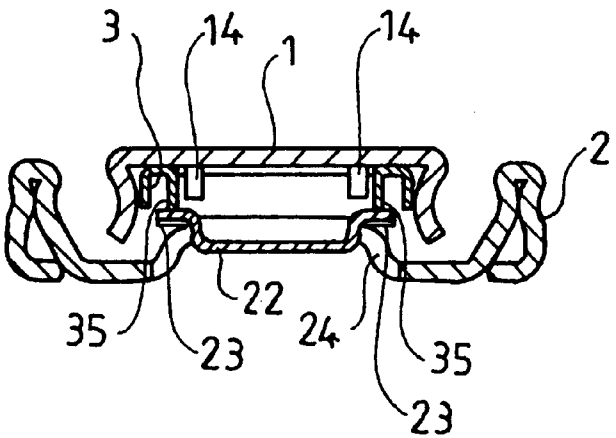
FIG. 7 is a cross-sectional view of the lock snap structure of a slide rail along line 7—7 as shown in FIG. 6.
Figure 8:
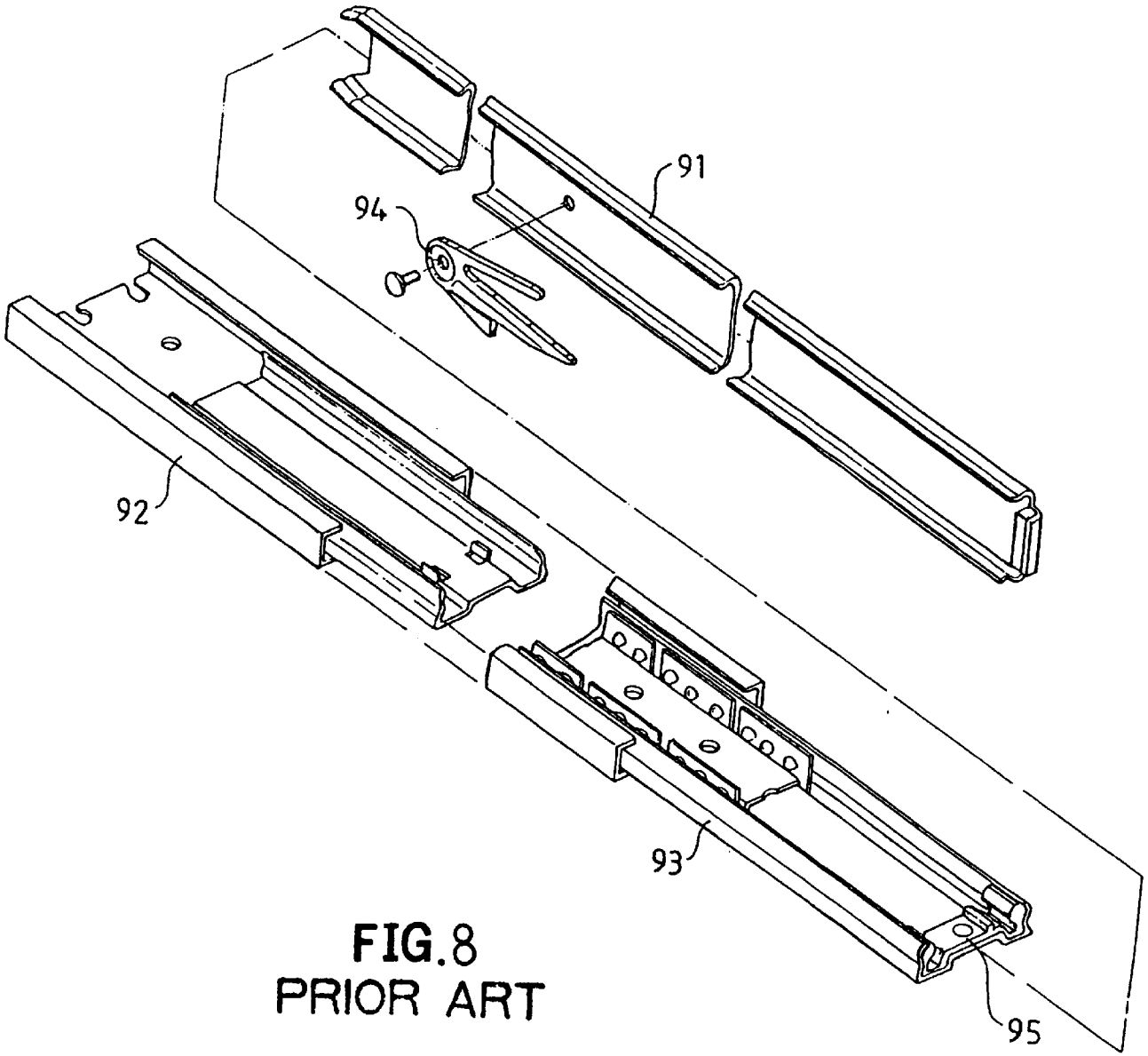
FIG. 8 PRIOR ART
FIG. 8 is an exploded perspective view of a conventional slide rail in accordance with the prior art.

Referring to FIGS. 6 and 7, when the user wishes to push back the drawer 4, or to remove the drawer 4 from the furniture, that is, the inner rail 1 may be detached from the outer rail 2, the user may grip the lug 33 to pull the drawing plate 3 outward, so that the guide plate 35 of the drawing plate 3 may push the guide block 23 to rise by the two oblique shoulders 37. The height of the oblique shoulder 37 is greater than that of the first locking plate 13*a* and the second locking plate 13*b,* so that the guide block 23 is pushed and raised by the guide plate 35 to detach from the locking groove 14, thereby detaching the inner rail 1 from the outer rail 2. Thus, the inner rail 1 may be moved relative to the outer rail 2, so that the user may push back the drawer 4, or remove the drawer 4 from the furniture. In addition, in accordance with the preferred embodiment of the present invention, the maximum height of the first locking plate 13*a* is designed to be slightly smaller than that of the second locking plate 13*b,* thereby preventing the drawer 4 from detaching from the furniture at one time.

Accordingly, the lock snap structure of a slide rail in accordance with the present invention has a simple construction. The drawing plate is used to control detachment or retraction of the drawer, and is mounted between the inner rail and the outer rail. Thus, the lock snap structure in accordance with the present invention will not have the problem of unintentional pressing or touching. In addition, when the drawer is pulled outward to the maximum length, it will form a positioning status. Further, the detachment action of the lock snap structure in accordance with the present invention is convenient.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lock snap structure of a slide rail, comprising:

an inner rail, having a face provided with at least one first locking plate and at least one second locking plate, a locking groove defined between the first locking plate and the second locking plate, adjacent ends of the first locking plate and the second locking plate having a greater height, each of the first locking plate and the second locking plate formed with a slope which is inclined and lowered from the adjacent end toward the other end;

an outer rail mounted on the inner rail, the outer rail provided with a retaining plate, the retaining plate formed with at least one protruding guide block, the guide block capable of climbing and rising along the slope of the first locking plate and the second locking plate of the inner rail to enter the locking groove between the first locking plate and the second locking plate; and a drawing plate, mounted between the inner rail and the outer rail, and moved in a longitudinal direction, one end of the drawing plate capable of being pulled, the other end of the drawing plate being pulled by one end of an elastic member, the other end of the elastic member being hooked on the inner rail, such that the drawing plate can be returned to its original position, the drawing plate formed with a slot hole to allow protrusion of the first locking plate and the second locking plate of the inner rail, the slot hole of the drawing plate formed with at least one guide plate, the guide plate having two sides each formed with an oblique shoulder, the oblique shoulder of the guide plate capable of pressing the guide block of the retaining plate when the drawing plate is moved, so that the guide block may detach from the locking groove between the first locking plate and the second locking plate of the inner rail.

2. The lock snap structure of a slide rail as claimed in claim 1, wherein the retaining plate of the outer rail is formed with two guide blocks, the inner rail is formed with two opposite first locking plates, and two opposite second locking plates arranged symmetrically with each other, the drawing plate is provided with two guide plates, so that the two pairs of locking plates of the inner rail and the two guide plates of the drawing plate may be rested on the two guide blocks of the outer rail respectively.

3. The lock snap structure of a slide rail as claimed in claim 1, wherein the inner rail may be fixed on a drawer.

4. The lock snap structure of a slide rail as claimed in claim 1, wherein the outer rail may be fixed on a wall of a furniture.

5. The lock snap structure of a slide rail as claimed in claim 1, wherein the outer rail is formed with a slot hole to allow retraction of the retaining plate.

6. The lock snap structure of a slide rail as claimed in claim 1, wherein the drawing plate has a distal end provided with a lug.

7. The lock snap structure of a slide rail as claimed in claim 1, wherein the drawing plate is formed with an elongated slot for passage of a guide rod which is fixed in the inner rail, thereby limiting a distance of movement of the drawing plate.

8. The lock snap structure of a slide rail as claimed in claim 1, wherein a maximum height of the first locking plate is smaller than that of the second locking plate.

9. The lock snap structure of a slide rail as claimed in claim 1, wherein a maximum height of the guide plate is respectively greater than that of the first locking plate and the second locking plate.

* * * * *